United States Patent [19]

Last

[11] 4,408,719

[45] Oct. 11, 1983

[54] SONIC LIQUID ATOMIZER

[76] Inventor: Anthony J. Last, 191 King St., Oakville, Canada, L6J 1B3

[21] Appl. No.: 274,411

[22] Filed: Jun. 17, 1981

[51] Int. Cl.[3] ..... B05B 3/14

[52] U.S. Cl. ..... 239/102; 239/417

[58] Field of Search ..... 239/102, 103, 416, 539, 239/417

[56] References Cited

U.S. PATENT DOCUMENTS

| | | | |
|---|---|---|---|
| 1,624,806 | 4/1927 | Ryder et al. | 239/417 X |
| 3,064,619 | 11/1962 | Fortman | 239/102 X |
| 3,125,986 | 3/1964 | Fortman et al. | 239/102 X |

OTHER PUBLICATIONS

Mityushin, Y. P. and A. L. Kovalenko, *Thermal Engineering,* Jan. 1979, pp. 24–26.

*Primary Examiner*—Johnny D. Cherry
*Assistant Examiner*—Mary McCarthy
*Attorney, Agent, or Firm*—Westell & Hanley

[57] ABSTRACT

A sonic liquid atomizing device having a body member with a concave face and a resonator spaced from the face. An air nozzle projects through an opening in the face to form an annular aperture about the nozzle and an inlet for liquid connects with the annular aperture. The nozzle carries an axial stem on which the resonator is mounted and the nozzle is adjustable axially to vary the area of the annular aperture. The nozzle is tapered and its conical projection terminates on the axis of the stem between the resonator and a point one third of the distance between the resonator and the nozzle.

4 Claims, 2 Drawing Figures

SONIC LIQUID ATOMIZER

FIELD OF THE INVENTION

This invention relates to a sonic liquid atomizing device.

BACKGROUND OF THE INVENTION

Acoustic generators known as stem-jet or Hartmann whistles have been developed which produce a high frequency sonic vibration useful in spray drying and defoaming. Such a device is disclosed in U.S. Pat. No. 2,519,619 issued Aug. 22, 1950 in the name of J. I. Yallott et al in which a high velocity air jet stream impinges on a cavity resonator to produce a high energy vibratory sonic field at the resonator frequency.

This principle has been used to atomize a liquid into a micromist by projecting the liquid into the area of the sonic vibrations. One such generator is disclosed in U.S. Pat. No. 3,081,946 issued Mar. 19, 1963 in the name of R. S. Soloff in which the liquid to be atomized is projected through radial apertures in the body of the generator into the sound field. The problem with such a spray nozzle is that, except at a specific pressure of the liquid at a given volume of delivery, the liquid at the core of the jets issuing from the apertures are not as well atomized as the liquid near the lateral periphery of the jets and consequently larger droplets of liquid are contained in the spray. Consequently optimum operation of the device requires a predetermined constant pressure and rate of delivery of liquid which restricts it to a relatively narrow range of efficiency.

It is an object of the present invention to provide a sonic liquid atomizing device which is operable efficiently over a wider range of pressure of the liquid delivered to the device for atomization.

SUMMARY OF THE INVENTION

In its broadest aspect the invention consists of a sonic liquid atomizing device having a body member with a concave face and a resonator spaced from the face. An air nozzle projects through an opening in the face to form an annular aperture about the nozzle and an inlet for liquid connects with the annular aperture. The nozzle carries an axial stem on which the resonator is mounted and the nozzle is adjustable axially to vary the area of the annular aperture. The nozzle is tapered and its conical projection terminates on the axis of the stem between the resonator and a point one third of the distance between the resonator and the nozzle. Also, a tapered annular passage in the body member leads to the annular aperture with the side walls of the annular passage, which are defined by the body member and the nozzle, converging.

BRIEF DESCRIPTION OF THE DRAWINGS

An example embodiment of the invention is shown in the accompanying drawings in which.

DETAILED DESCRIPTION OF EXAMPLE EMBODIMENT

Figure 1:
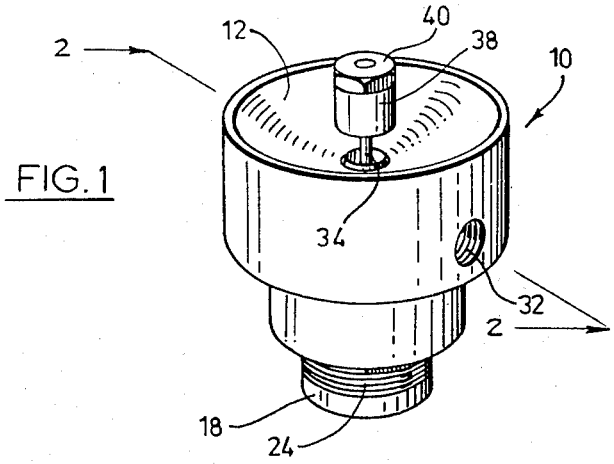
FIG. 1 is a perspective view of the device.
Figure 2:
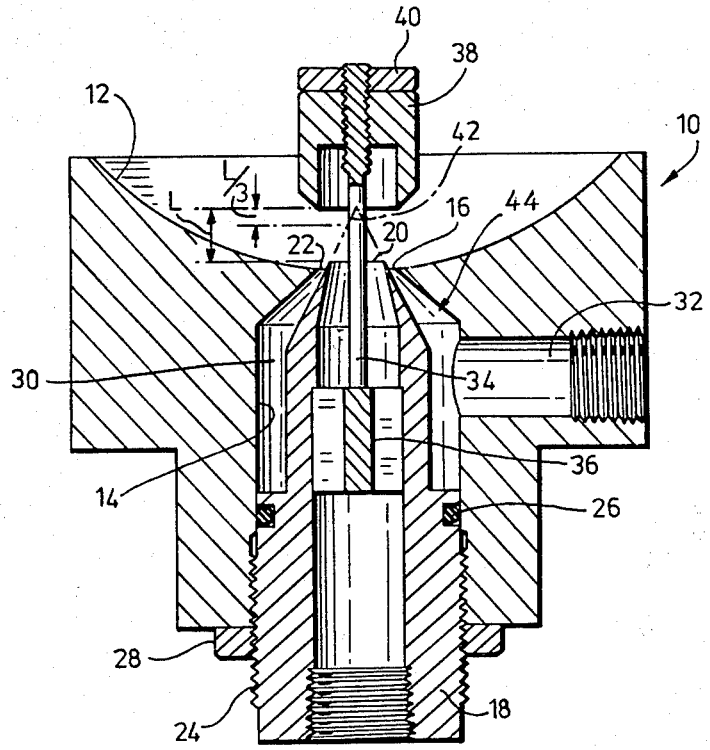
FIG. 2 is a cross-sectional view taken along line 2—2 of FIG. 1.

The example embodiment shown in the drawings consists of a main body member 10 which has a parabolic concave face 12. A first bore 14 extends through body member 10 and terminates in an opening 16 centrally located in face 12. A nozzle 18 is positioned coaxially in bore 14 with the outlet end 20 of the nozzle projecting through opening 16 of face 12. In this position outlet end 20 defines, with opening 16, an annular aperture 22 in face 12. Nozzle 18 has external threads 24 which engage internal threading in bore 14 and the nozzle also carries an O-ring seal 26. A lock nut 28 engages threads 24. Nozzle 18 is reduced in diameter between O-ring 26 and outlet end 20 to provide a chamber 30 within bore 14 and a second, lateral bore 32 in body member 10 opens into chamber 30.

Nozzle 18 carries a stem 34 which is positioned by a spider connection 36 to project coaxially from outlet end 20. A cavity resonator 38 is threaded onto that end of stem 34 projecting from nozzle 18 and the resonator, spaced from outlet end 20, is secured on the stem by a lock nut 40.

Nozzle 18 is tapered at the outlet end 20 and the slope of the taper is such that the conical projection 42 of the taper will terminate on a length of the axis of stem 34 between the resonator opposite face 12 and a point one third the distance L between the resonator and the outlet end of the nozzle. Also, the wall of chamber 30 is tapered towards the outlet end 16 to a knife-edge rim defining the outer circumference of aperture 22 and defines, with nozzle 18, a tapering annular passage 44 with converging side walls leading to annular aperture 22.

In the operation of the device air (or other suitable gas) is supplied from a source (not shown) at high pressure to nozzle 18. The air is directed from outlet end 20 at high velocity towards resonator 38 which is adjusted axially on stem 34 to the required distance from outlet end 20 to produce high frequency sonic vibrations which are reflected off face 12 of body member 10 in known manner. Liquid to be atomized is supplied under pressure from a source (not shown) to bore 32 of body member 10, passing into chamber 30 of bore 14 and thence through annular aperture 22. As the liquid passes through aperture 22 it encounters the sonic vibrations generated by resonator 38 and is atomized to form a micromist emanating from the device.

Given a constant pressure of gas and liquid delivered to nozzle 18 and bore 32 respectively, the quality of the micromist produced by the device may be varied by altering the flow of liquid issuing from annular aperture 22 and this is achieved by adjusting nozzle 18 axially to increase or decrease the area of the annular aperture. When nozzle 18 has been adjusted in this manner by rotating it on threads 24 it may be clamped in the selected position by lock nut 28.

In two sample tests of the described embodiment, water with a dissolved dye was supplied at four gallons per minute and air was supplied to nozzle 18 at 35 psi. The spray was allowed to settle on white Kromecote (a trade mark) paper and was assessed using image analysis of the stain size and distribution. The following results of the two tests were recorded:

| Distance from nozzle in inches | Relative number of droplets per $cm^2$ | Percent of droplets $<55\mu$ |
|---|---|---|
| | TEST 1 - 0.0205 inch aperture | |
| 9 | 149 | 13.5 |
| 14 | 115 | 13.7 |
| 24 | 85 | 11.9 |
| 32 | 107 | 12.7 |

-continued

| Distance from nozzle in inches | Relative number of droplets per $cm^2$ | Percent of droplets $<55\mu$ |
|---|---|---|
| TEST 2 - 0.0103 inch aperture | | |
| 9 | 197 | 18.0 |
| 14 | 308 | 18.3 |
| 24 | 183 | 19.0 |
| 32 | 125 | 24.0 |

The flow rate of water in these two tests was constant while the pressure required was 30 psi for the 0.0205 inch aperture and 80 psi for the 0.0103 inch aperture.

It will be seen that the ability to vary the size of the aperture from which the liquid emanates allows control of the droplet size in the spray.

I claim:

1. A sonic liquid atomizing device comprising:

a body member having a concave face and a bore having a tapered outlet end terminating in an opening centrally located in the face;

a nozzle member mounted in the bore of the body member and having an externally tapered outlet end projecting through the opening in the face of the body member to provide, with the bore, a tapering annular passage circumscribing the nozzle and having converging side walls in the direction of the opening in the face of the body member, the nozzle being adjustable axially to vary the area of the annular aperture;

a stem mounted axially in the nozzle and carrying a resonator spaced from the outlet end of the nozzle and from the concave face of the body member;

inlet means in the body member connecting with the annular passage for the passage of liquid therethrough; and inlet means in the nozzle connecting with the tapered outlet end for the passage of gas therethrough;

the converging projection of the tapered outlet end of the nozzle terminating on the axis of the stem between the resonator and a point one third of the distance from the resonator to the outlet end of the nozzle.

2. A device as claimed in claim 1 in which the resonator is adjustable axially on the stem.

3. A device as claimed in claim 1 in which a first bore through the body member terminates in the central opening in the face thereof, the nozzle being mounted in the bore end defining, with the bore, an annular chamber connecting with the annular aperture, the liquid inlet means comprising a second bore terminating in the annular chamber.

4. A device as claimed in claim 3 in which the nozzle is threaded into the body member and is adjustably secured therein by a lock nut.

* * * * *